US008028828B1

(12) United States Patent
English Darmstadt

(10) Patent No.: US 8,028,828 B1
(45) Date of Patent: Oct. 4, 2011

(54) TRANSFORMABLE INSTRUMENT STORAGE CASE AND STAND

(76) Inventor: Pia J. English Darmstadt, Cairo (EG)

( * ) Notice: Subject to any disclaimer, the term of this patent is extended or adjusted under 35 U.S.C. 154(b) by 0 days.

(21) Appl. No.: 12/868,482

(22) Filed: Aug. 25, 2010

(51) Int. Cl.
*A45C 11/00* (2006.01)

(52) U.S. Cl. ..... 206/45.24; 206/314

(58) Field of Classification Search ..... 206/45.2, 206/45.21, 45.23, 45.24, 314, 14; 84/327, 84/329
See application file for complete search history.

(56) References Cited

U.S. PATENT DOCUMENTS 3,618,885 A * 11/1971 Muller ..... 248/460
4,126,222 A * 11/1978 Aust ..... 206/326
4,223,785 A 9/1980 Jacques
4,474,290 A * 10/1984 DeMato ..... 206/314
5,435,437 A * 7/1995 Sasaki ..... 206/45.23
5,509,527 A * 4/1996 Wang ..... 206/746
5,522,300 A * 6/1996 Cheatwood ..... 84/453
5,833,051 A 11/1998 Tiefenbrun et al.
7,565,970 B1 * 7/2009 Erskine ..... 206/314
7,649,131 B1 1/2010 Yu
2002/0104426 A1 8/2002 Fediakov
2004/0217026 A1 11/2004 Neilson

* cited by examiner

*Primary Examiner* — Jacob K Ackun
(74) *Attorney, Agent, or Firm* — Oliff & Berridge, PLC

(57) ABSTRACT

An instrument case that is transformable into a stand for holding the instrument includes a base and a movable portion, including of a plurality of panels, attached at one end to the base. To transform the case into a stand, the movable portion is moved toward the base, thereby causing panels to rotate outwardly from a center of the instrument case, creating legs of the stand.

19 Claims, 20 Drawing Sheets

TRANSFORMABLE INSTRUMENT STORAGE CASE AND STAND

BACKGROUND

The present disclosure relates generally to an instrument case that is transformable into an instrument stand ("transformable device") and a method of using the transformable device. More particularly, the present disclosure relates to a musical instrument case that is transformable into a musical instrument stand. The transformable device may be configured for wind instruments such as, for example, wind instruments of a tubular shape, but may also be configured for other musical instruments, medical or science instruments of a sterile or non-sterile nature, objects for presentation such as museum pieces or advertisements, objects in the packing and transporting industry where a transformable device may be used as a container for objects to be unpacked or presented without contact/handling and the like. The transformable device of the present disclosure provides a single transformable device for instrument storage and/or carrying of the instrument inside a compartment of the device, as well as secure holding of the instrument in a transformed arrangement of the device, for example during use in a concert or practice.

Typical instrument cases require a user to partially or completely dismantle an instrument to be stored in the case. The dismantling process is not desirable to a user because the dismantling process may be tedious and/or complicated. Further, dismantling an instrument may cause problems such as misplaced or broken parts and may wear out an instrument faster than an instrument that does not need to be dismantled.

Additionally, because ordinary instrument cases are not configured to also function as an instrument stand, a user is required to separately purchase and carry an instrument stand. This is also undesirable because it requires the user to maintain and carry two separate items, the case and the stand, which adds bulk and may be cumbersome to carry and set up.

It is thus desirable for an instrument case to be configured for use as both a case and a stand. For example, a device that is transformable between an instrument case and an instrument stand is desirable.

SUMMARY

The present disclosure provides an apparatus and method incorporating, for example, an instrument case and instrument stand in a single transformable device.

An instrument case is provided that is transformable into a stand for holding the instrument. The instrument case that is transformable into a stand for holding the instrument includes a base and a movable portion comprised of a plurality of panels attached at one end to the base.

DETAILED DESCRIPTION

Figure 1:
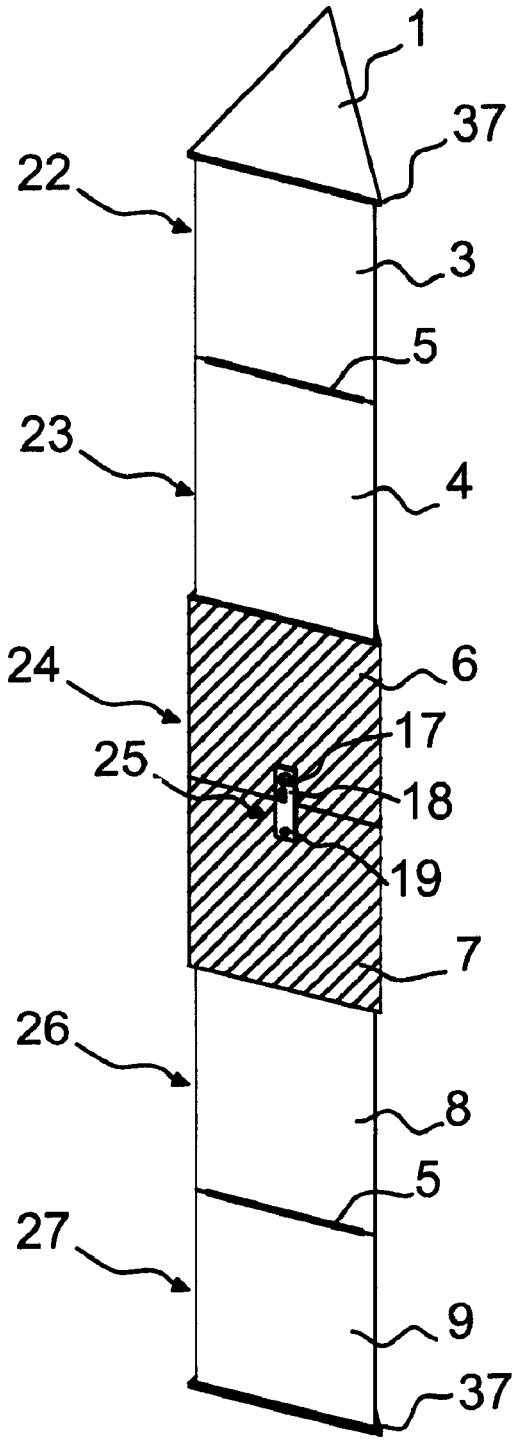
FIG. 1 is a perspective view of a transformable device in a closed state.

The present disclosure is addressed to instrument cases that are transformable into instrument stands and methods of using the transformable devices. Embodiments of such instrument cases include a base and a movable portion, comprised of a plurality of panels, attached at one end to the base.

Such a transformable device has a case configuration wherein the instrument is housed within outer walls of the transformable device. In the case configuration, the instrument contained within the transformable device may be readily transported or carried by a user. The case configuration also provides protection, for example, from abrasion, falls, moisture or the like, for the instrument housed within the instrument case. Additionally, while in the case configuration, the transformable device may be locked to prevent theft, loss, accidental openings of the case and the like.

Such transformable devices are also capable of transforming, partially or completely, from the case configuration to a stand configuration. In the stand configuration, the instrument is at least partially exposed (i.e., not contained within the instrument case) so that the instrument may be readily removed from the case, or supported in a manner that allows the instrument to be accessed by a user.

Such transformable devices may generally comprise a base, and a movable portion that is comprised of a plurality of panels. The transformable devices may be transformed from the case configuration to the stand configuration by moving the movable portion along a longitudinal axis of the transformable device, thereby exposing the instrument. By moving the movable portion of the transformable device along the longitudinal axis of the transformable device, at least some of the walls of the device that house the instrument in the case configuration, cooperate in a manner such that the cooperating walls become support parts, such as supporting legs, for the transformable device in the stand configuration.

Such transformable devices may be configured for use with one or more types of instruments, such as wind musical instruments. Examples of wind musical instruments include, but are not limited to, a flute, piccolo, clarinet, recorder, soprano saxophone and the like. Transformable devices of the present disclosure are not limited to wind instruments, but may also be configured to be used for other known or later developed musical instruments, science instruments, or objects where a transformable device may be used for storage, packing or presentation.

Details of exemplary embodiments will be described with reference to the drawing Figures, wherein like numerals refer to the same components throughout.

Generally, as shown in FIG. 1, the transformable device is in a case configuration. In this configuration, the walls/panels of the transformable device define an interior chamber configured to hold an instrument for storage, transport, carrying, protection and the like. The transformable device comprises at least a base 28 (FIG. 5) and a movable portion comprised of a plurality of panels.

In embodiments, the movable portion comprises an upper case portion 22, an upper movable portion 23 and a lower movable portion 26. In embodiments, the base may include a lower case portion 27. The upper case portion 22 is comprised of one or more top panels 3, the upper movable portion 23 is comprised of one or more upper panels 4, the lower case portion 27 is comprised of one or more bottom panels 9 and the lower movable portion 26 is comprised of one or more lower panels 8.

The upper panels 4 and the lower panels 8 may have chamfered side edges that allow the upper panels 4 to have adjacent edges that abut one another without interference. Similarly, the lower panels 8 may have chamfered side edges that allow adjacent edges to abut one another without interference.

Although FIG. 1 shows the transformable device taking in a triangular prism shape (having the cross-section of a triangle), the transformable device is not so limited and may take other shapes. In embodiments, the transformable device may comprise a cross-sectional shape that is a regular or irregular shape including, but not limited to: triangular, rectangular, square, oval, circular, prismatic and the like and combinations thereof.

Figure 2:
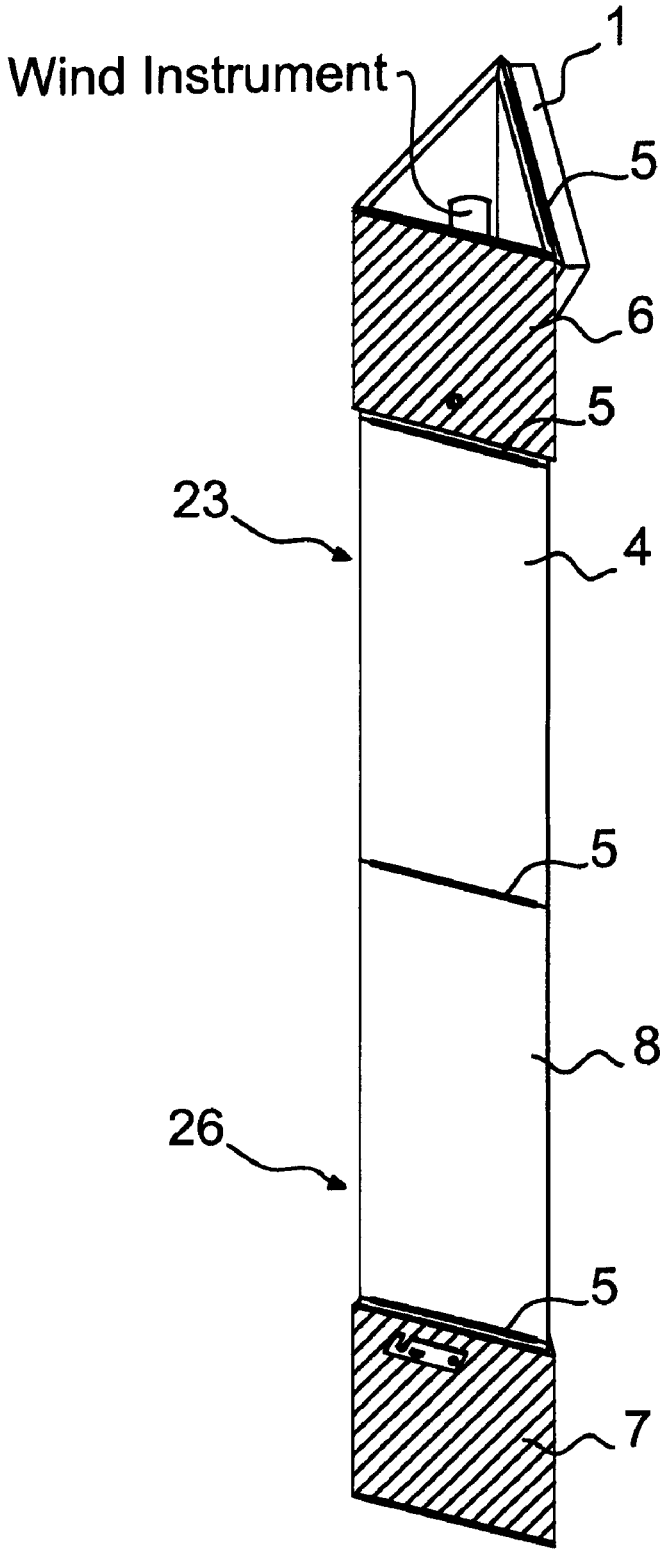
FIG. 2 is a perspective view of a transformable device in an open state and having sliding sleeves in a pushed outward state.
Figure 5:
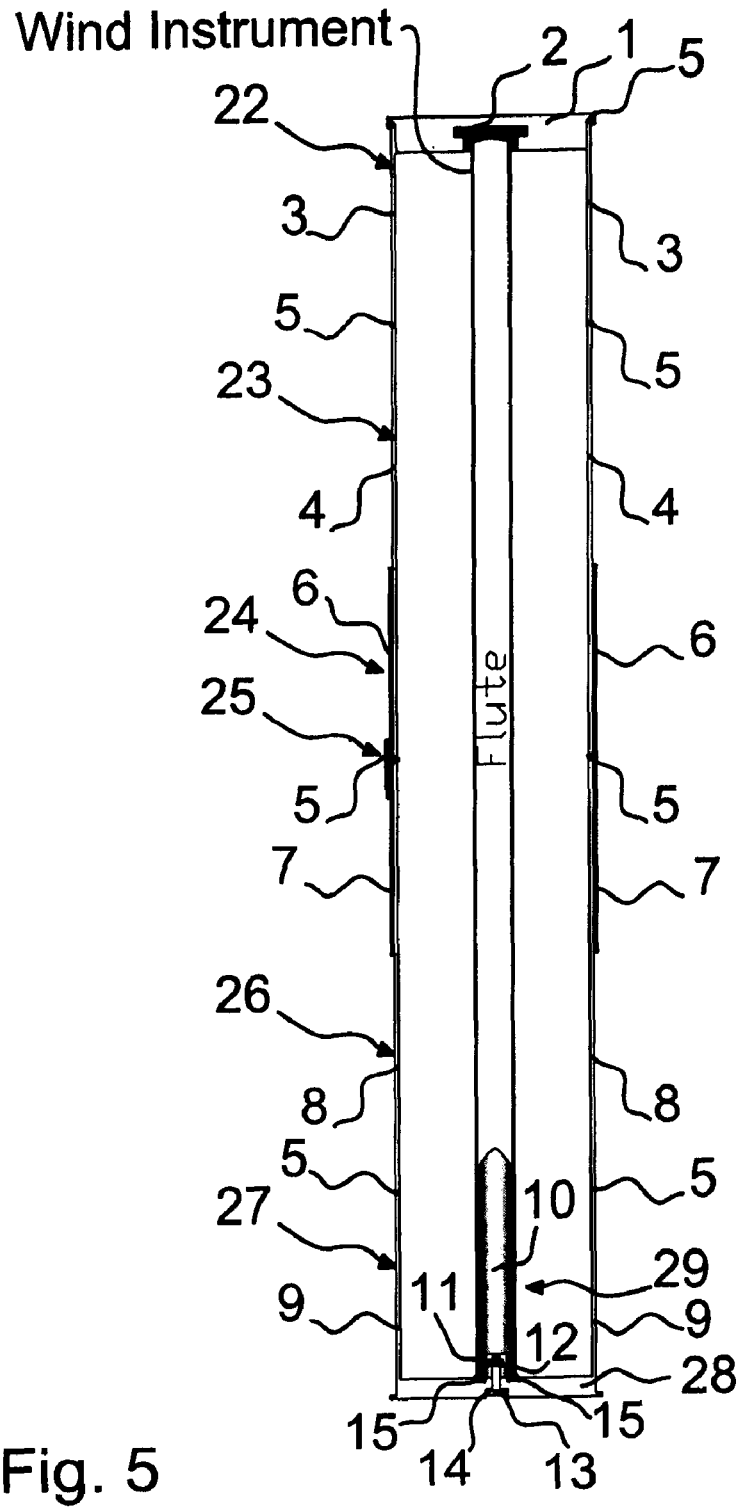
FIG. 5 is a vertical section of a transformable device in a case configuration.

The upper case portion 22 may be removably or rotatably connected to a lid 1. The lid 1 may be secured to any of the top panels 3 via a pivotable portions 5. The pivotable portions 5 may, for example, comprise a hinge, flexible connection or the like, which allows the lid 1 to open, for example, by rotating around an axis of the pivotable portion 5. The lid 1 may be rotated about 270 degrees from the closed position to be in an open position, in which the lid rests against, and is substantially parallel with, a panel of the device (FIG. 2). The lid 1 may include a holding member 2, such as a sponge or molded piece, for holding the instrument securely in the transformable device when the lid is in the closed position and the instrument is in the case (FIG. 5).

Figure 7:
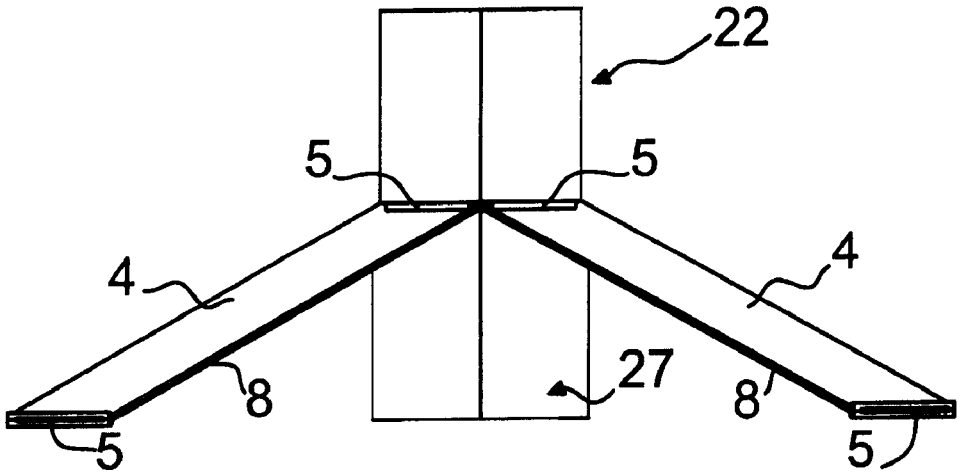
FIG. 7 is a vertical view of a transformable device in an instrument stand configuration.
Figure 8:
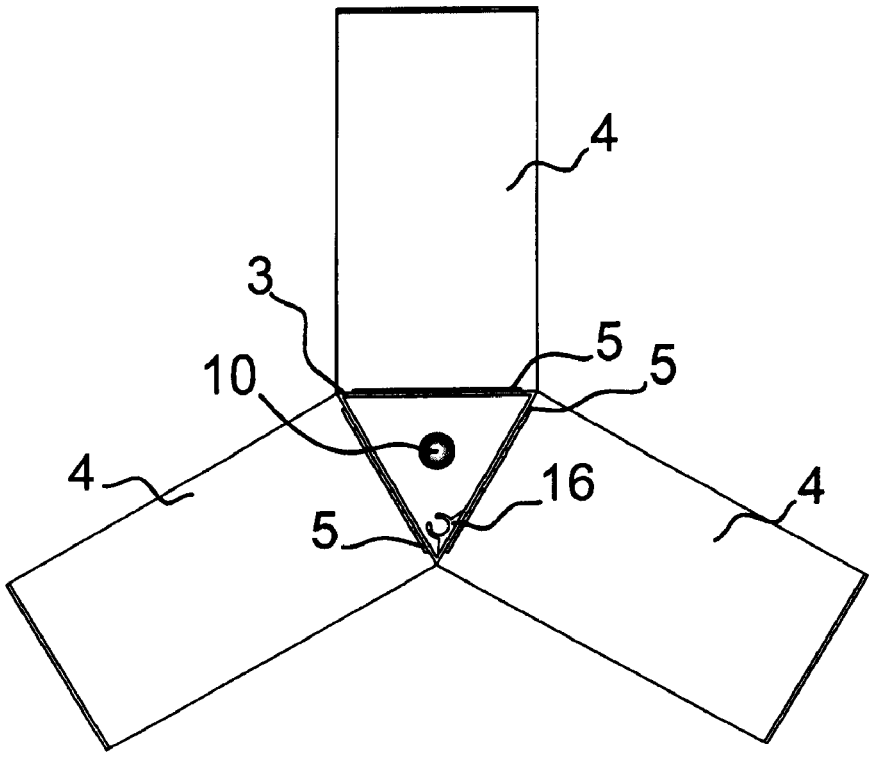
FIG. 8 is a top view of a transformable device in an instrument stand configuration.

The upper case portion 22 is connected to the upper movable portion 23 via one or more pivotable portions 5. The pivotable portions 5 may be connected to the upper case portion 22 and the upper movable portion 23 in a manner that allows for movement of the upper case portion 22 along a longitudinal axis of the transformable device toward the lower case portion 27 for switching the transformable device from the case configuration to the stand configuration. As shown in FIGS. 7 and 8, the upper case portion 22 may be connected to the upper panels 4 of the upper movable portion 23 on each side via pivotable portions 5.

The lower case portion 27 may be similarly connected to the lower movable portion 26 via one or more pivotable portions 5. The pivotable portions 5 may be connected to the lower case portion 27 and the lower movable portion 26 in a manner that allows for movement of the lower case portion 27 along the longitudinal axis of the transformable device. The lower case portion 27 may be connected to the lower panels 8 of the lower movable part on each side via pivotable portions 5. The movement along the longitudinal axis of the lower case portion 27 may desirably be along the same axis as the movement of the upper case portion 22.

The transformable device may be fitted with a locking device 24 that slides over an outer circumference of one or more of the upper case portion 22, upper movable portion 23, lower movable portion 26 and lower case portion 27 when the transformable device is in the case configuration. When locked, this prevents the case from undesirably collapsing or changing to the stand configuration. For example, the locking device may prevent the pivotable portions 5 that connect upper movable portion 23 to lower movable portion 26 from flexing, thus maintaining the device in the case configuration.

Figure 9:
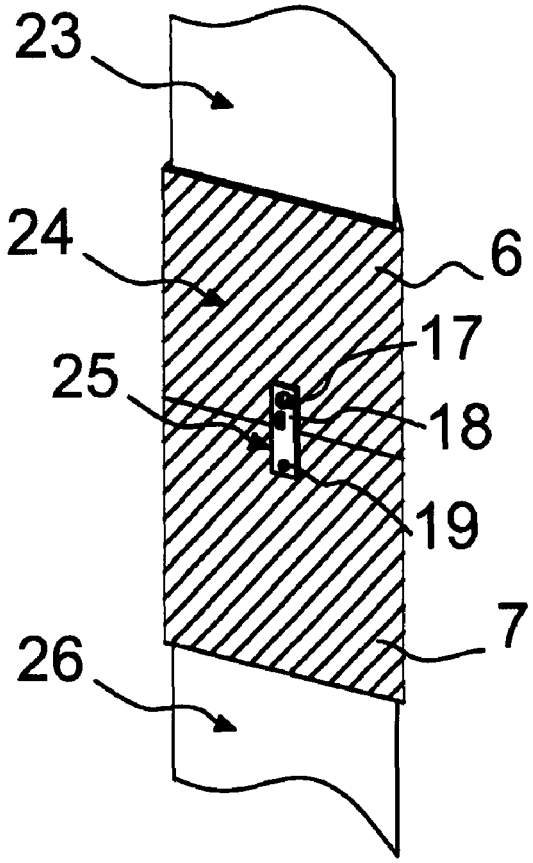
FIG. 9 is a detail in perspective view showing a locking device of a transformable device with an upper sliding sleeve and lower sliding sleeve and a fastening device for the sliding sleeves.
Figure 10:
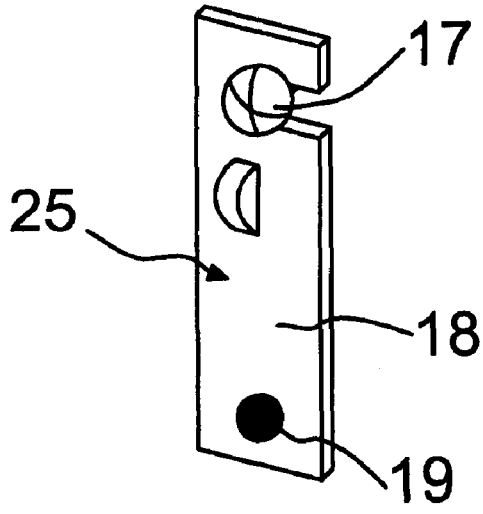
FIG. 10 is a detail in perspective view showing a fastening device of a transformable device.

The locking device 24 may be comprised of one or more sliding sleeves, such as an upper sliding sleeve 6 and a lower sliding sleeve 7. The locking device 24 may further comprise any suitable mechanism for locking the sliding sleeves in place when in the case configuration. Such a mechanism may include, for example, a fastening device 25 comprising a knob 17, a lever 18 and a rotatable attachment point 19, such as a rivet. In embodiments, the locking device 24 may also comprise, for example, a clip, hook, latch, fastener, pin, clasp, snap, tie or the like. The fastening device 25 may be located on one or more sides of the locking device 24. When the upper sliding sleeve 6 and lower sliding sleeve 7 are moved to a closed position or case configuration position of the transformable device such that they abut each other, the lever 18 may be rotated around the rotatable attachment point 19 and affixed to the knob to lock the transformable device in the case configuration. For example, a locked case configuration is shown in FIGS. 1, 9 and 10, whereas an unlocked configuration is shown in FIG. 2.

The upper sliding sleeve 6 may be restricted in upward movement by a protrusion 37 formed at or near the top of the upper case portion 22. Similarly, the lower sliding sleeve may be restricted in downward movement by a protrusion 37 formed at or near the bottom of the lower case portion 27. The protrusions 37 may prevent the sliding sleeves from undesirably sliding off of the transformable device when not locked. When the sliding sleeves are unlocked, and the sliding sleeves are slid toward their respective ends of the transformable device (i.e., toward the protrusions 37), the pivotable portions 5 are freed, and may be flexed to open the transformable device. Open, in this regard, means either opened sufficiently to make it easier to remove the instrument even though not fully in the stand configuration, or opened to fully open/transform the device to the stand configuration.

Figure 6:
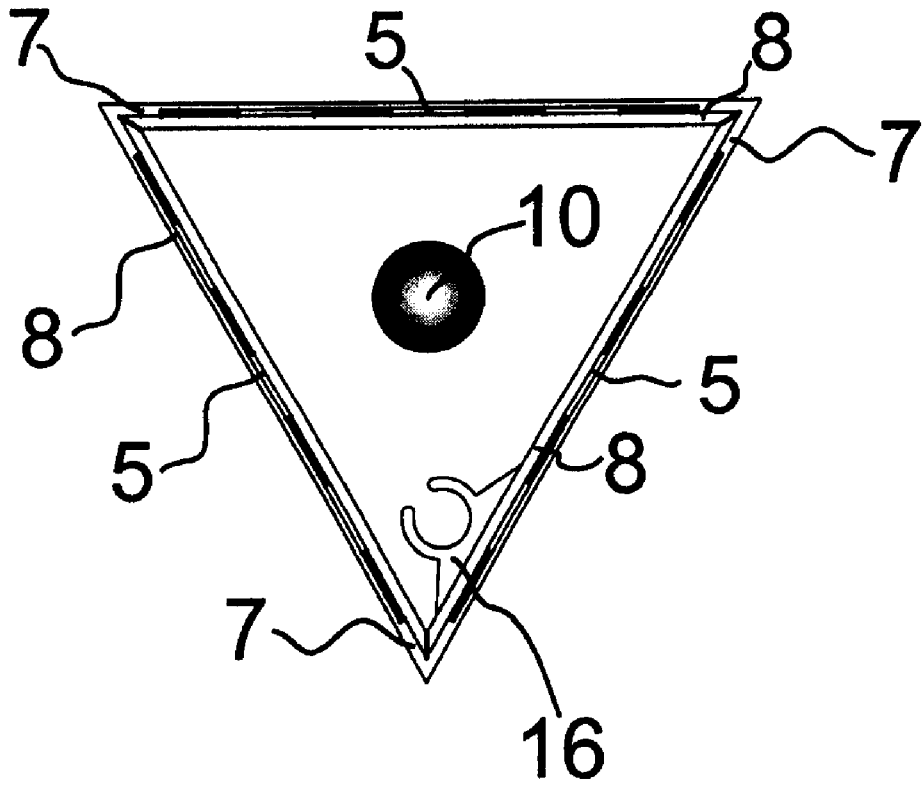
FIG. 6 is a horizontal section of a transformable device.
Figure 11:
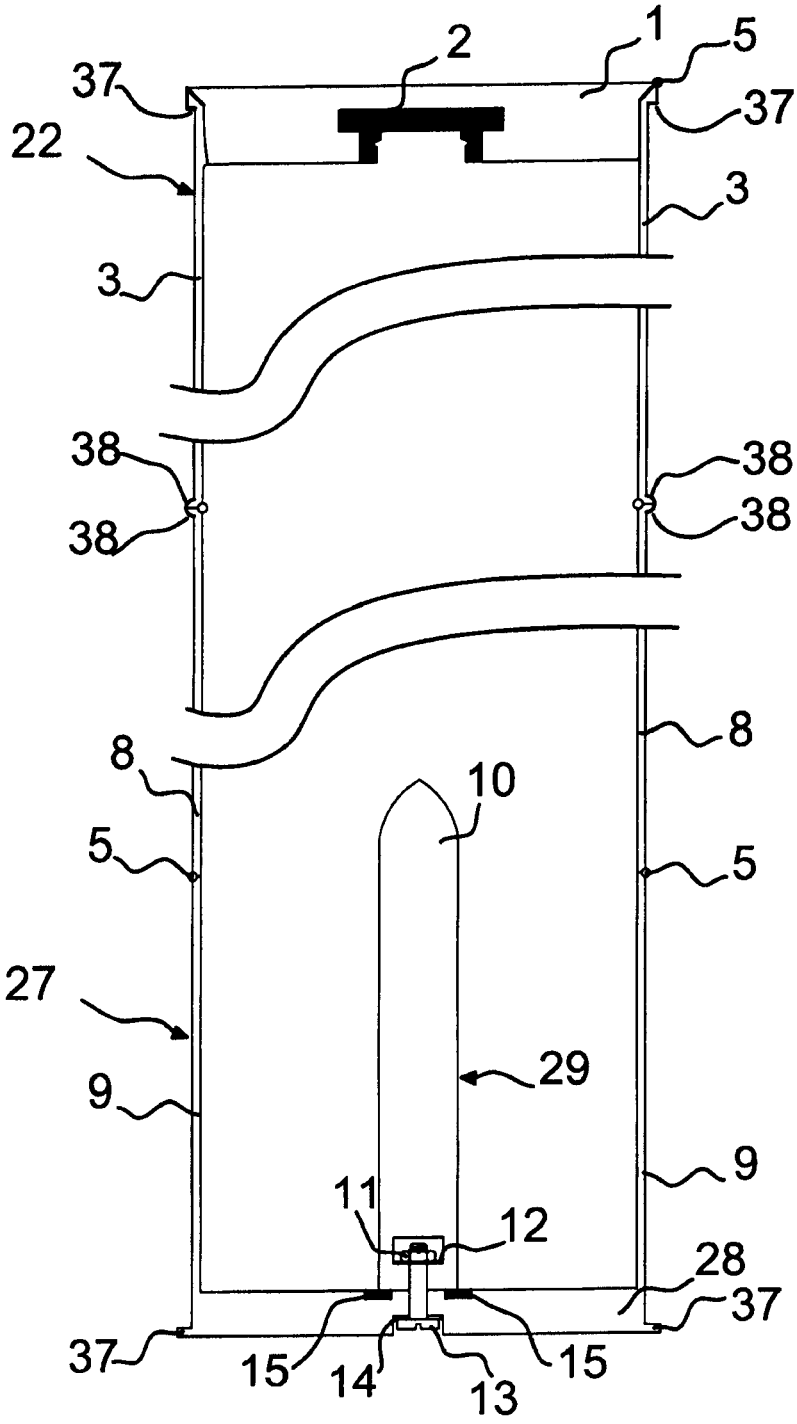
FIG. 11 is a locally enlarged view of a vertical section of a upper case portion, upper panels and lower panels with protrusions and a lower case portion of a transformable device.

As shown in FIGS. 5 and 11, the lower case portion 27 may include a holding device 29 located, for example, at a center of the base 28 of the lower case portion 27 located on an interior of the transformable device. The holding device 29 may comprise a holding structure 10 and an elastic ring 15. The elastic ring 15 may have a diameter only slightly larger than a diameter of the holding structure 10 and be fitted to the outside of the holding structure 10 or to the base 28 to provide cushioning for an instrument, particularly a wind instrument, held within the transformable device. The holding structure 10 functions to hold the instrument, for example, by being inserted into a portion of the instrument (i.e., a rod) or being placed around the instrument (i.e., a tube). FIG. 6 shows an example placement of the holding structure 10 within the lower case portion 27.

The holding structure 10 may be affixed to the base 28 via a nut 11, washer 12, a second washer 14 and a bolt 13. As shown in FIG. 5, the bolt 13 may be inserted through a bottom of the base 28 through a through-hole formed in the base into the interior of the transformable device. Alternatively, the bolt 13 may be integrally formed to the base 28. The base 28 and holding structure 10 may also be a unitary molded structure.

Figure 22:
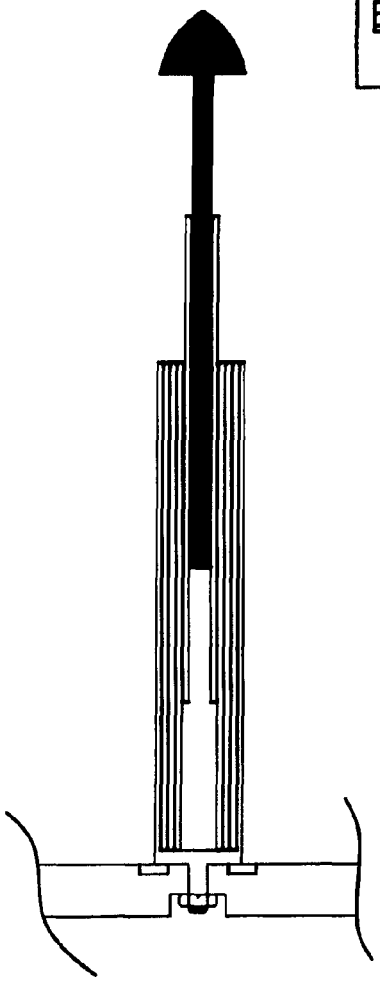
FIGS. 22 and 23 show a transformable device including a telescopic sheet music holder.
Figure 23:
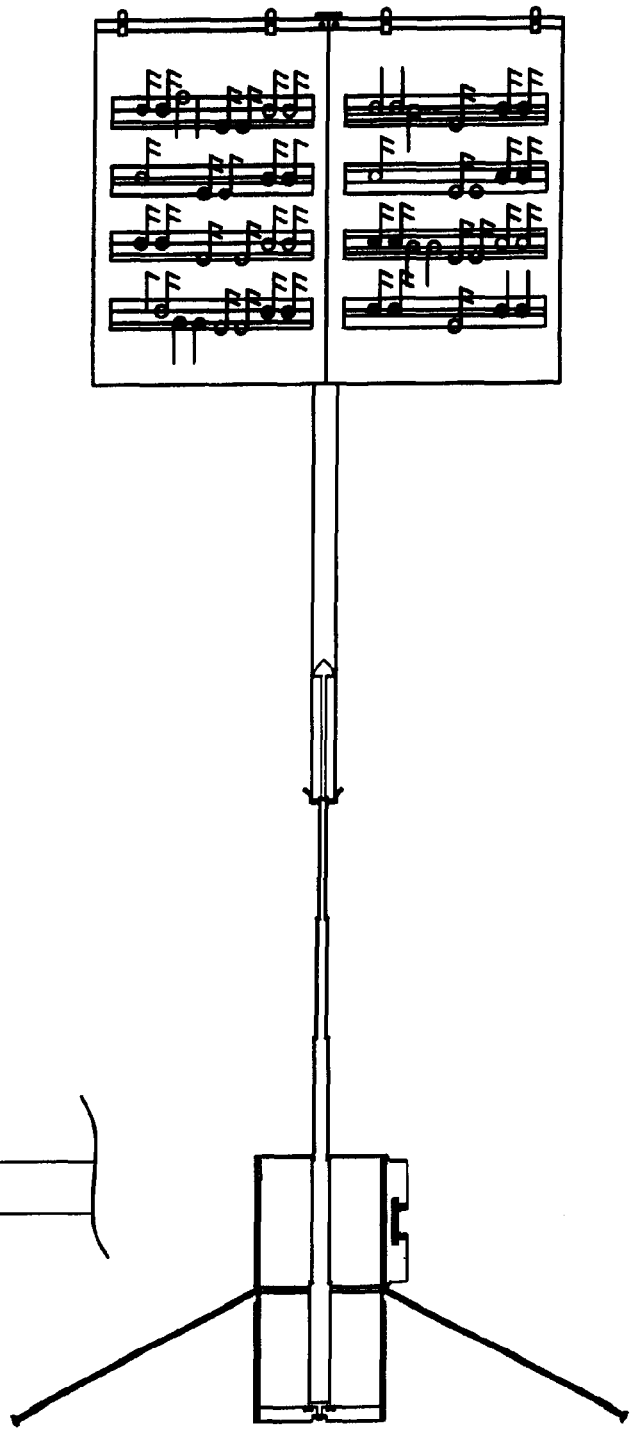

As shown in FIGS. 6 and 8, the upper case portion 22 and lower case portion 27 may each include one or more fastening clips 16 on one or more inside portions of the top panels 3 or bottom panels 9. The fastening clip 16 may be used, for example, for fastening a cleaning rod of the instrument or a telescopic sheet music holder (FIGS. 22 and 23) within the transformable device. The fastening clips 16 that are located on the bottom panels 9 may be replaced by a tube to insert the cleaning rod or sheet music holder.

Figure 3:
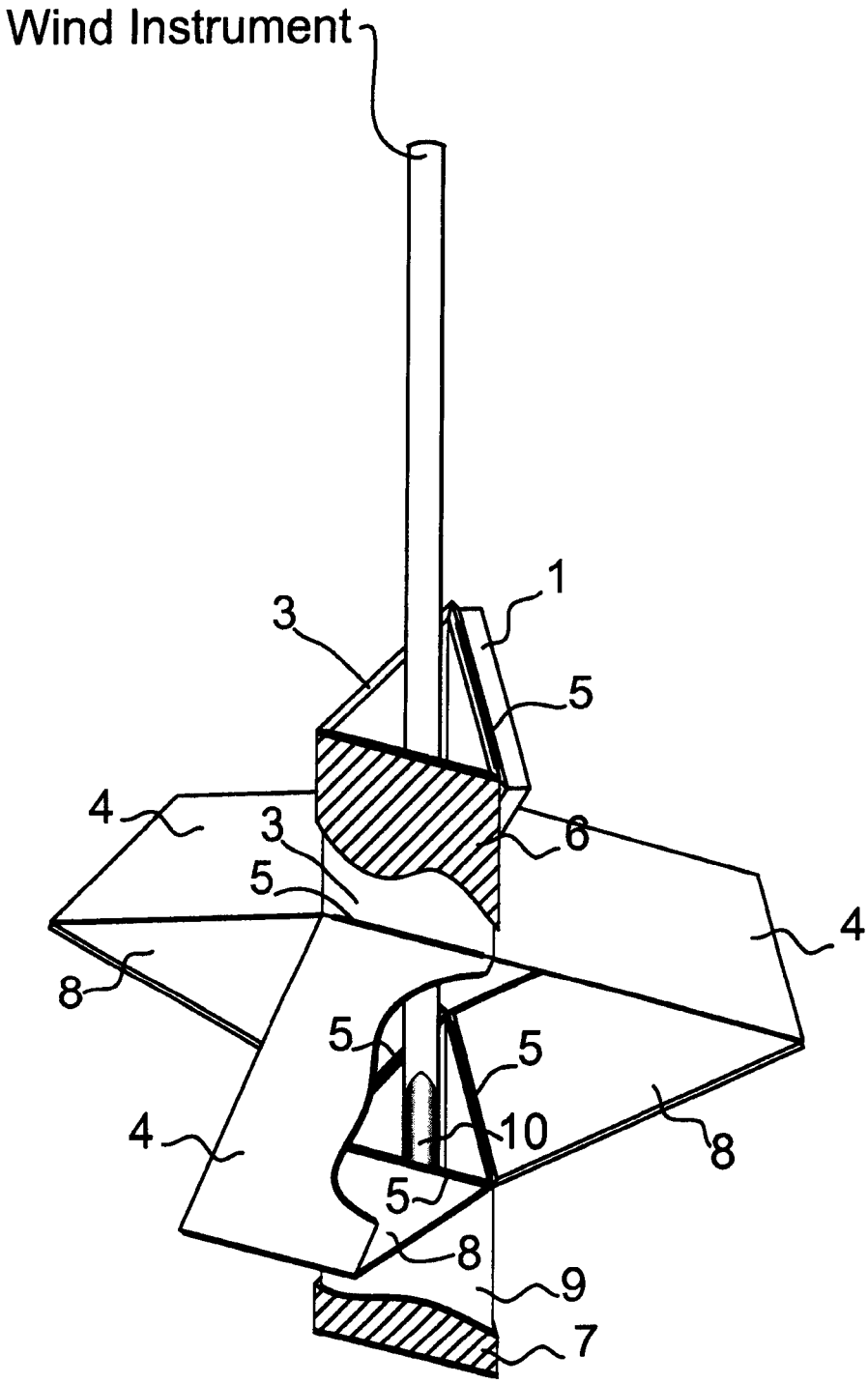
FIG. 3 is a perspective view of a transformable device in a state having upper and lower side panels partially down.
Figure 4:
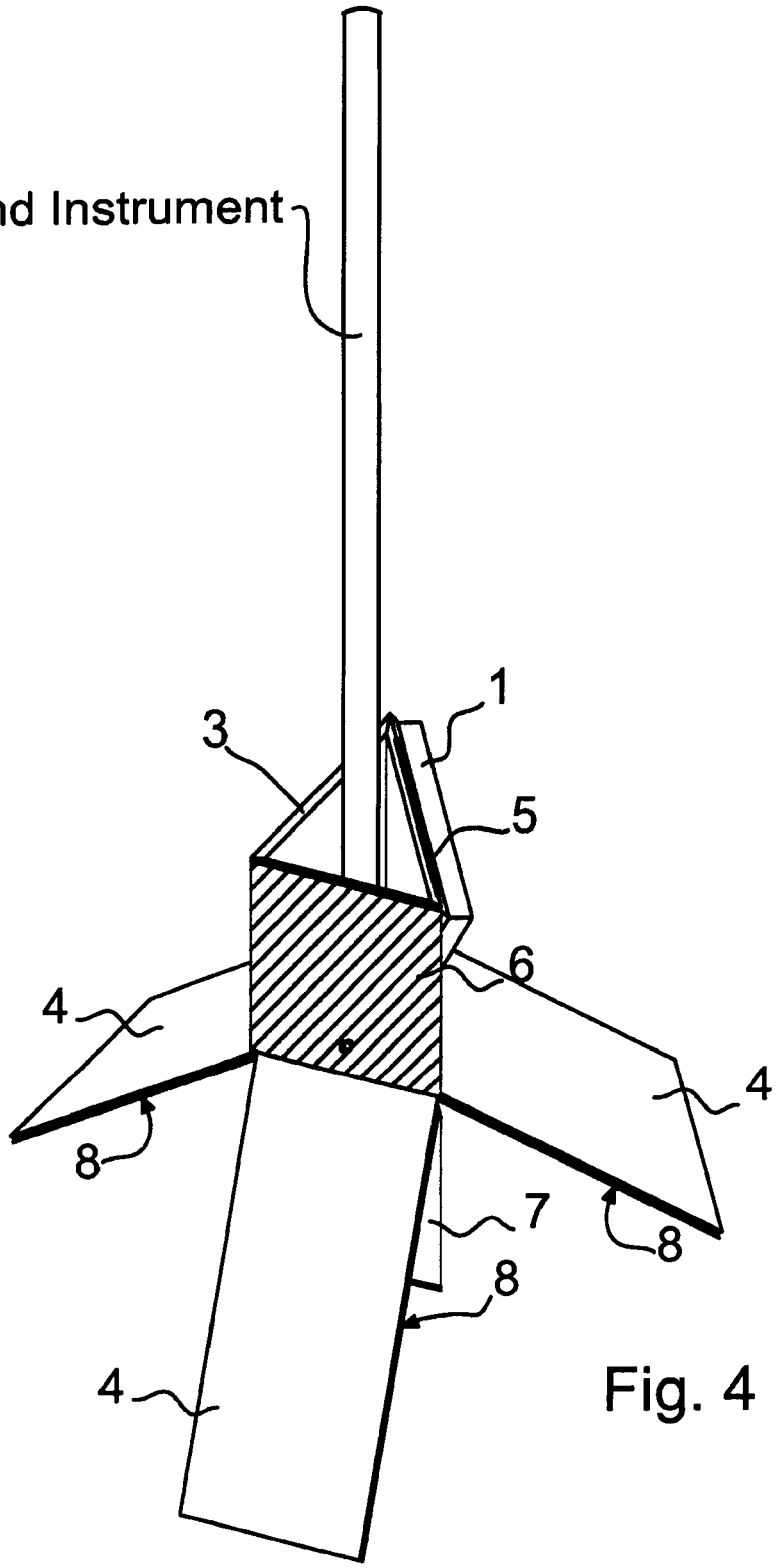
FIG. 4 is a perspective view of a transformable device in an instrument stand configuration having the upper and lower panels fully down.
Figure 17:
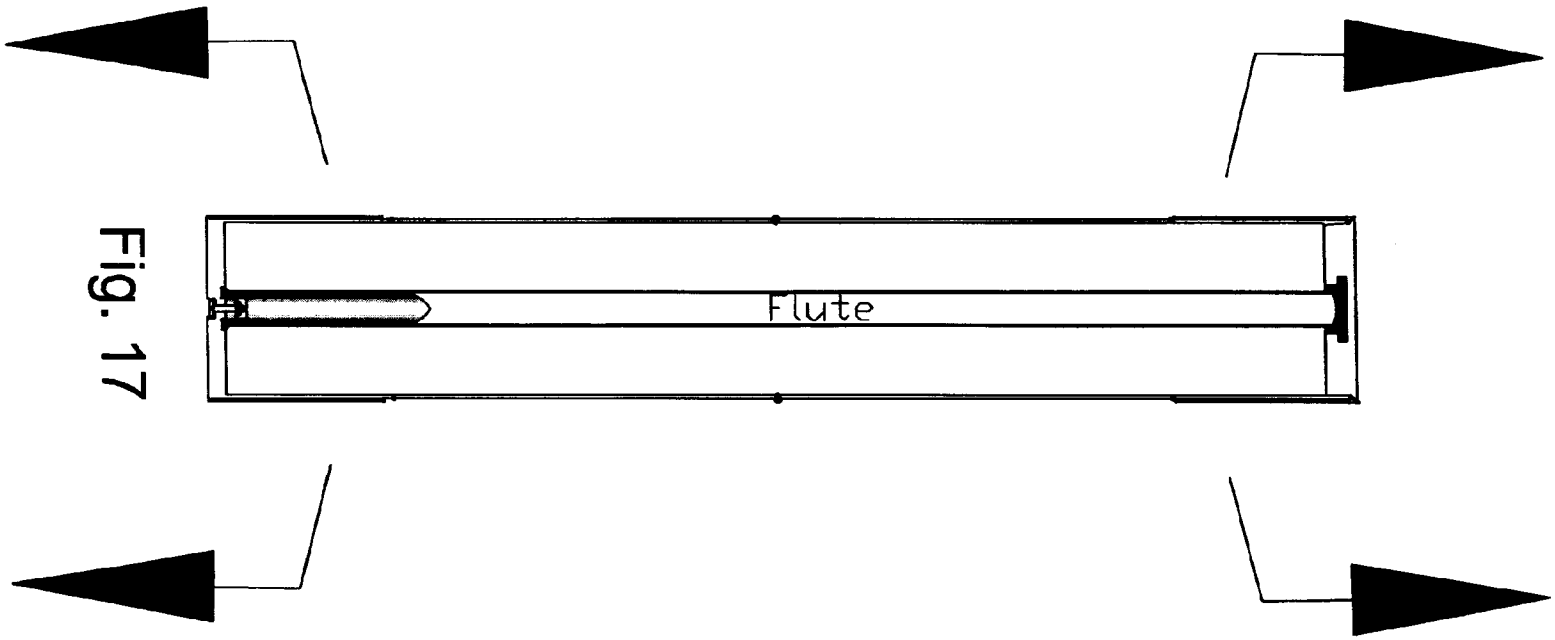
Figure 18:
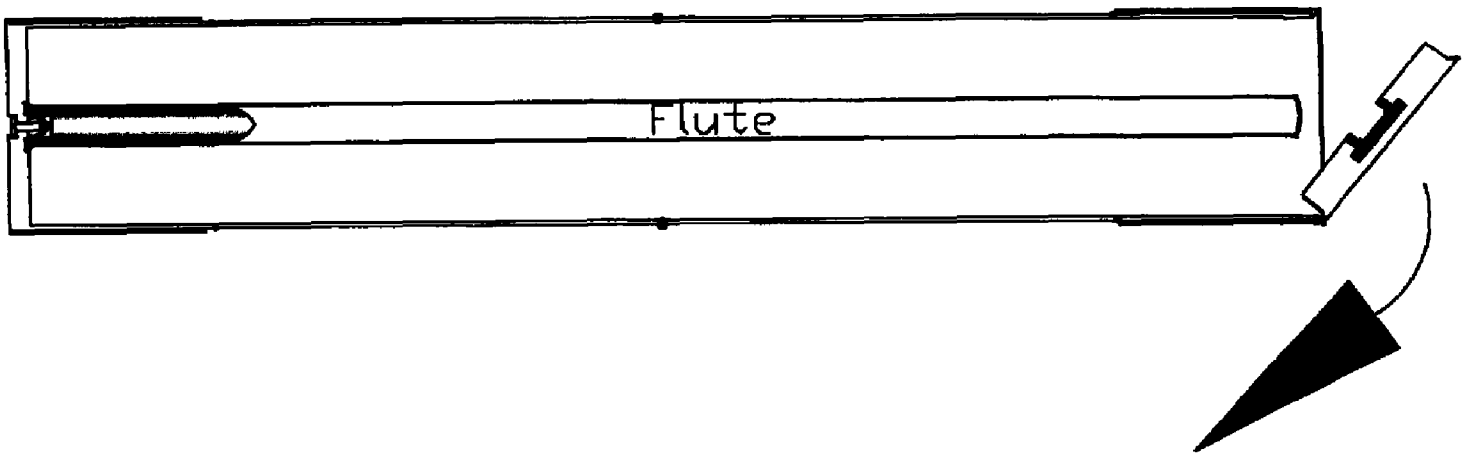
Figure 19:
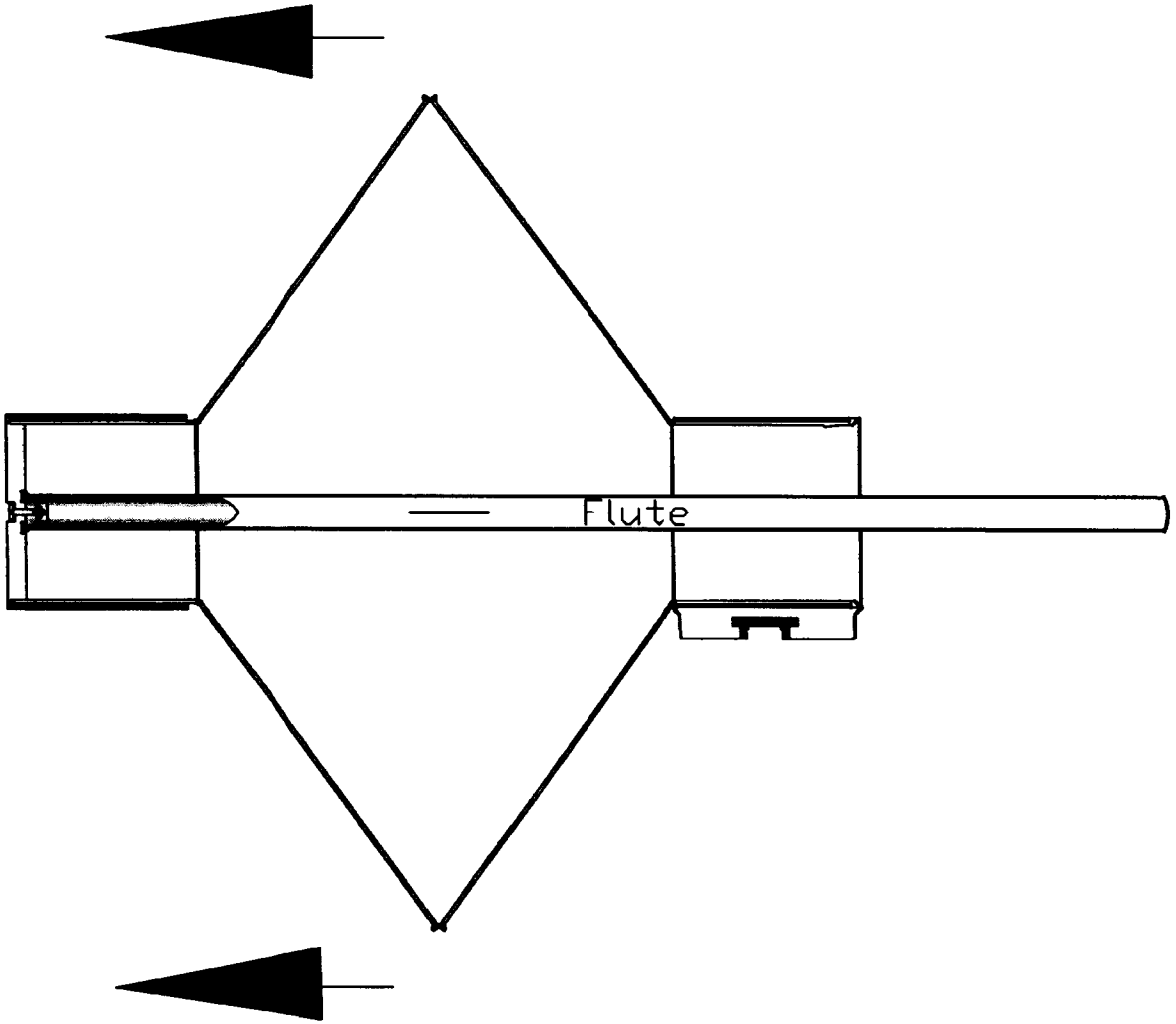
Figure 21:
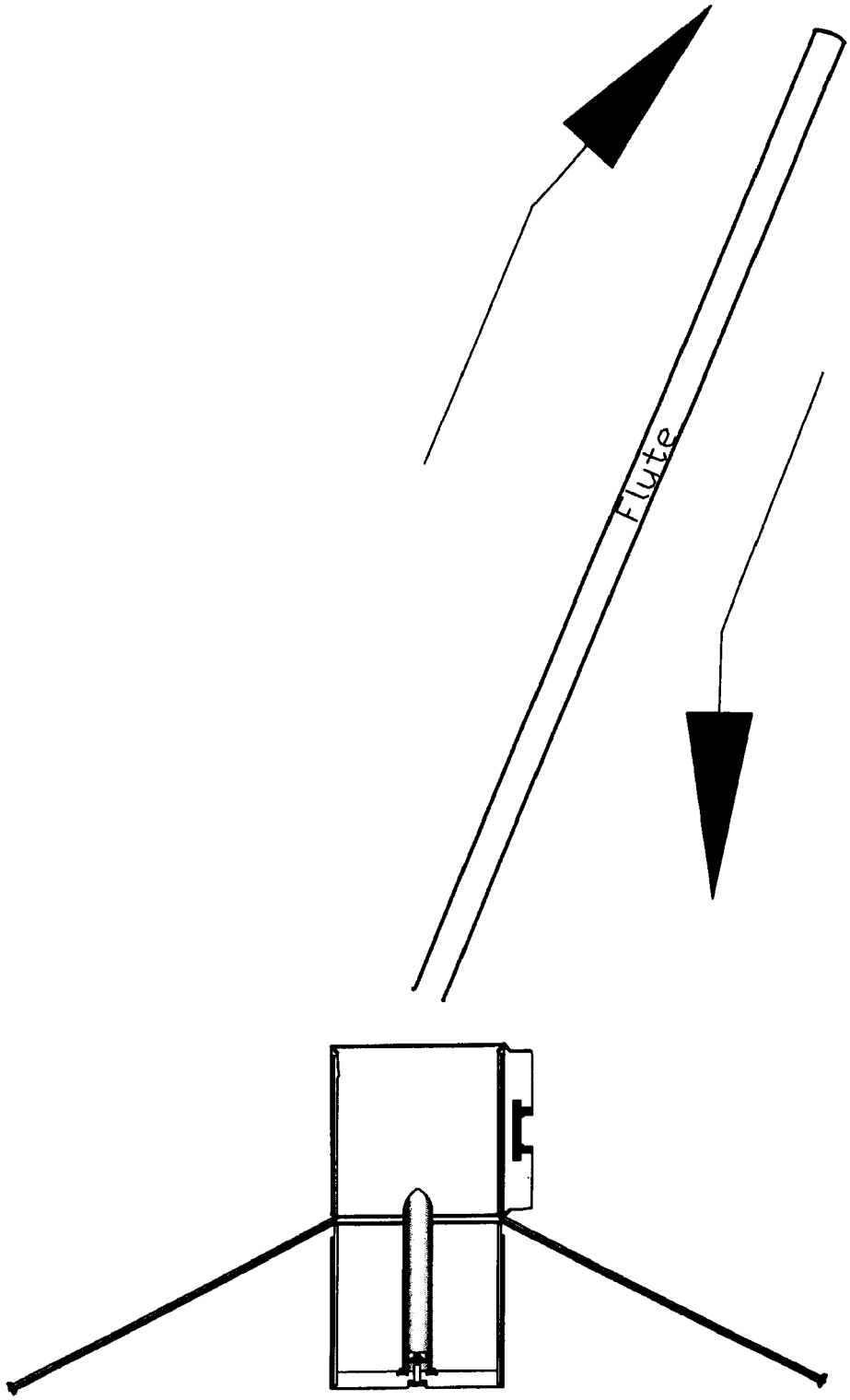

Transformation of the transformable device from a case configuration to a stand configuration will be further explained. The fastening device 25 is unlocked. In embodiments, unlocking may be by rotating the lever 18 around the rotatable attachment point to disconnect the lever from the knob 17. The lid 1 is set to an open state, such as that shown in FIGS. 2 and 18. The upper sliding sleeve 6 and lower sliding sleeve 7 are moved along the longitudinal axis of the transformable device toward the protrusions 37, as shown in FIG. 17. The lower case portion 27 is intended to be placed on a surface, such as the floor. The upper case portion 22 is pushed (or pulled) along the longitudinal axis of the transformable device in a direction toward the base 28, as shown in FIG. 19. This action causes the upper panels 4 and the lower panels 8 to rotate outward and downward (FIGS. 3 and 4) by flexing at the pivotable portions 5. When flexed, inner sides of the upper panels 4 and the lower panels 8 are brought to abut each other when the device is fully opened. The upper panels 4 and lower panels 8, via the flexing at the pivotable portions 5, will rotate outward and in a direction away from the upper case portion 22 (i.e., toward the floor) until contacting the rigid surface, thus forming a base (which would be a tripod base in the case of a three panel prism shape). The base is formed by the action of the upper case portion 22 being pushed along the longitudinal axis of the transformable device in a direction toward the base 28, which causes the pivotable portions 5 between the upper panels 4 and the lower panels 8 to splay outwardly and downwardly. A foot portion (i.e., the part touching the floor) of the base is comprised of the protrusions 38 (FIG. 11) between the upper panels 4 and the lower panels 8. The instrument may then be removed, if desired, as shown in FIG. 21. In this stand configuration, the device can hold the instrument while not being used, but may also be used to hold another stand (e.g., a telescopic extendable stand for holding sheet music, if desired).

Figure 16:
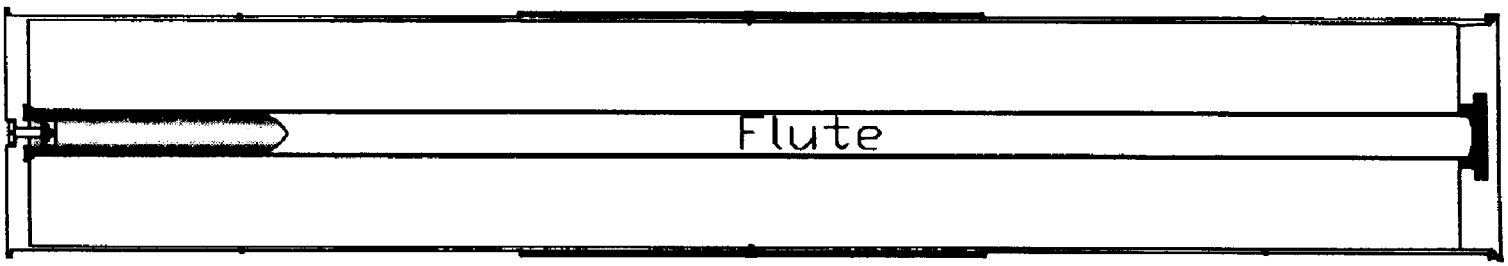
FIGS. 16-21 show a transformable device at different stages of transformation between a case configuration and a stand configuration.
Figure 20:
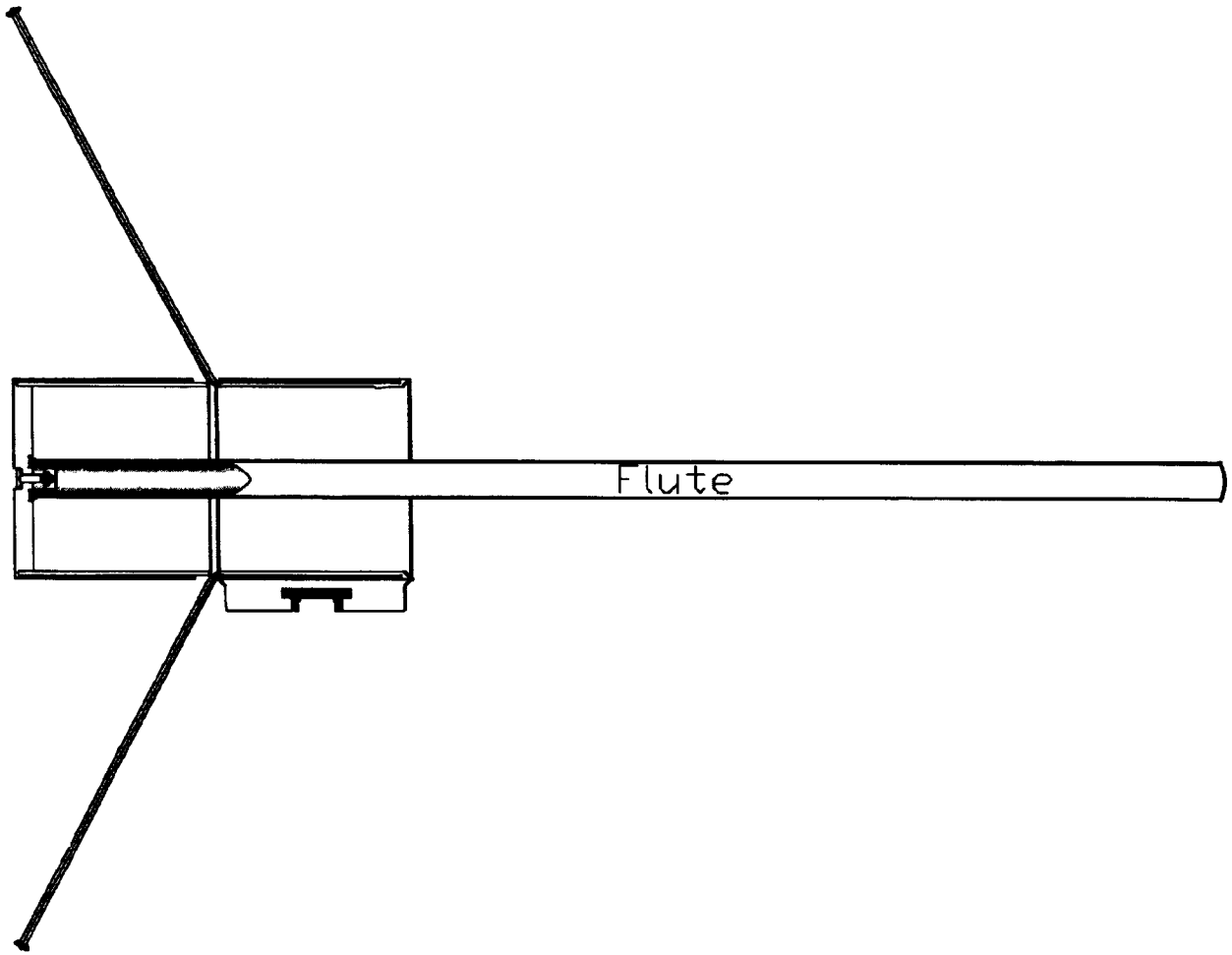

To transform the instrument case from a stand configuration (FIG. 20) to a case configuration (FIG. 16), the upper case portion 22 is lifted upwardly. The upper panels 4 and lower panels 8 may be pushed (or pulled) inwardly and upwardly until the transformable device is fully extended into its case configuration, as shown for example in FIG. 2. The sliding sleeves are slid into the closed position, such that they abut one another, such as at the point where they are restricted in movement by the protrusions 38, and are locked in position with the fastening device. In an embodiment wherein the upper panels 4 and the lower panels 8 have chamfered side edges, the case is extended until corresponding adjacent edges of the upper panels 4 and the lower panels 8, respectively, abut one another.

Figure 15:
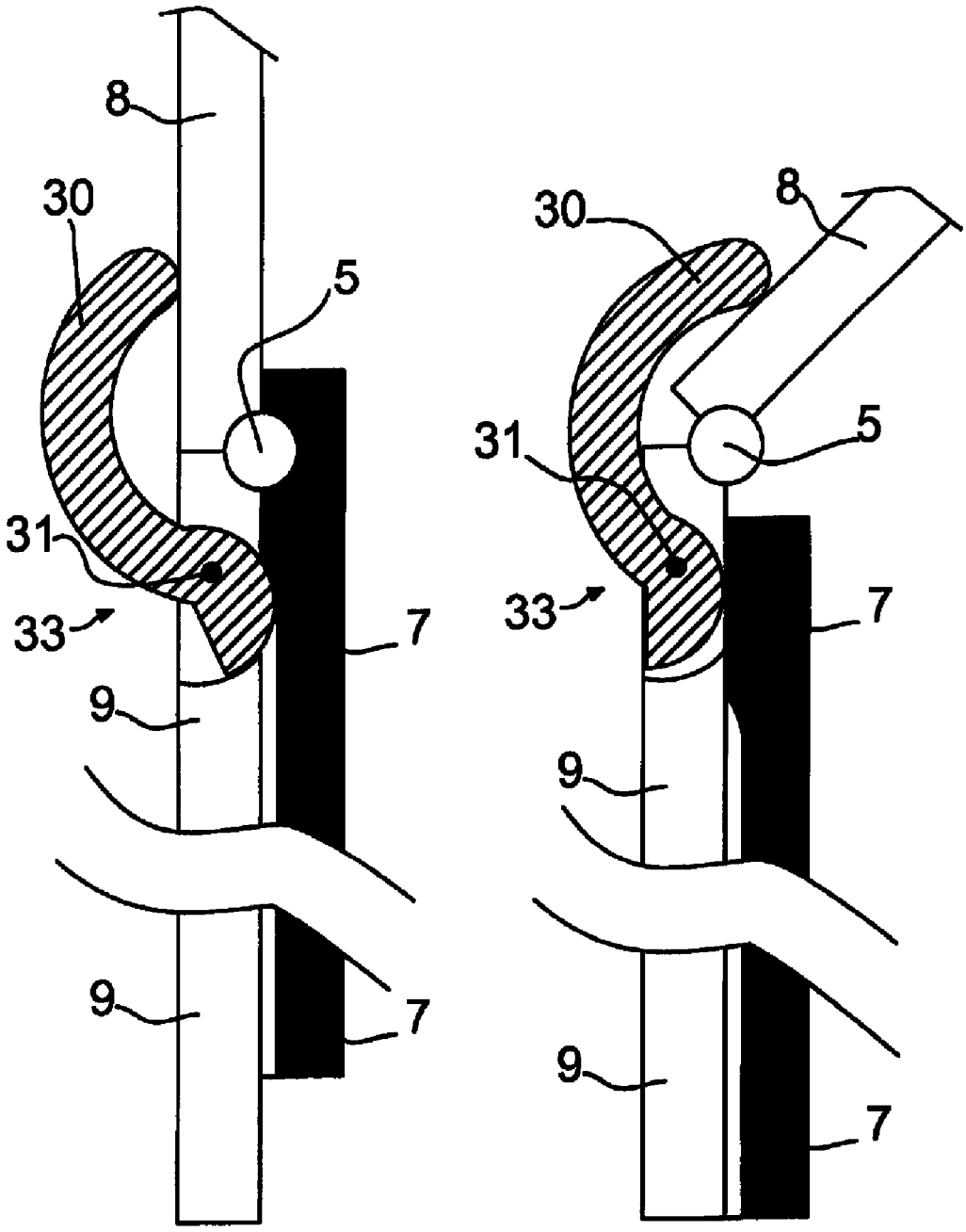
FIGS. 15(A) and 15(B) are a locally enlarged view of a mechanism aiding the initial outward movement of the upper panels and the lower panels of the transformable device of FIG. 1.

In embodiments, an assisting device 33 that assists in the outward rotation of the lower panels 8 may be attached to the bottom panels 9 at a location on an exterior side of the transformable device near one or more of the pivotable portions 5 (FIGS. 15A and 15B). The assisting device 33 may comprise a swivel 30 that is pivotable on an axle 31. As the lower sliding sleeve 7 is passed over the assisting device 33, the assisting device 33 is pressed against the lower panel 8 to assist in the outward rotation of the lower panel 8. The lower sliding sleeve 7 may have a furrow in line with the swivel 30 to keep the swivel 30 inactive until the lower sliding sleeve 7 has passed the pivotable portion 5 to a point between the lower panel 8 and bottom panel 9, thus allowing the lower panel 8 to be able to freely rotate. The action of the swivel 30 against the lower panel 8 assists in the outward rotation of the lower panel 8 when changing the transformable device from the case configuration to the stand configuration.

Figure 13:
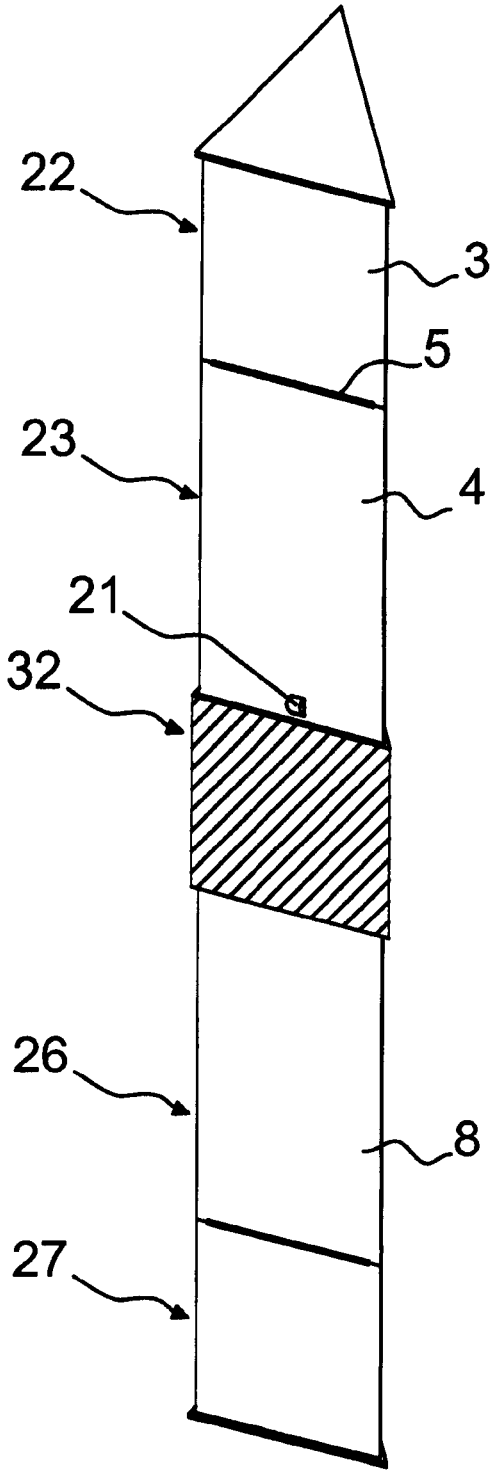
FIG. 13 is a perspective view of a transformable device with only one sliding sleeve for closing the case and a fastening clip for holding the single sliding sleeve in place, in accordance with another variation for fastening cases for small instruments.
Figure 14:
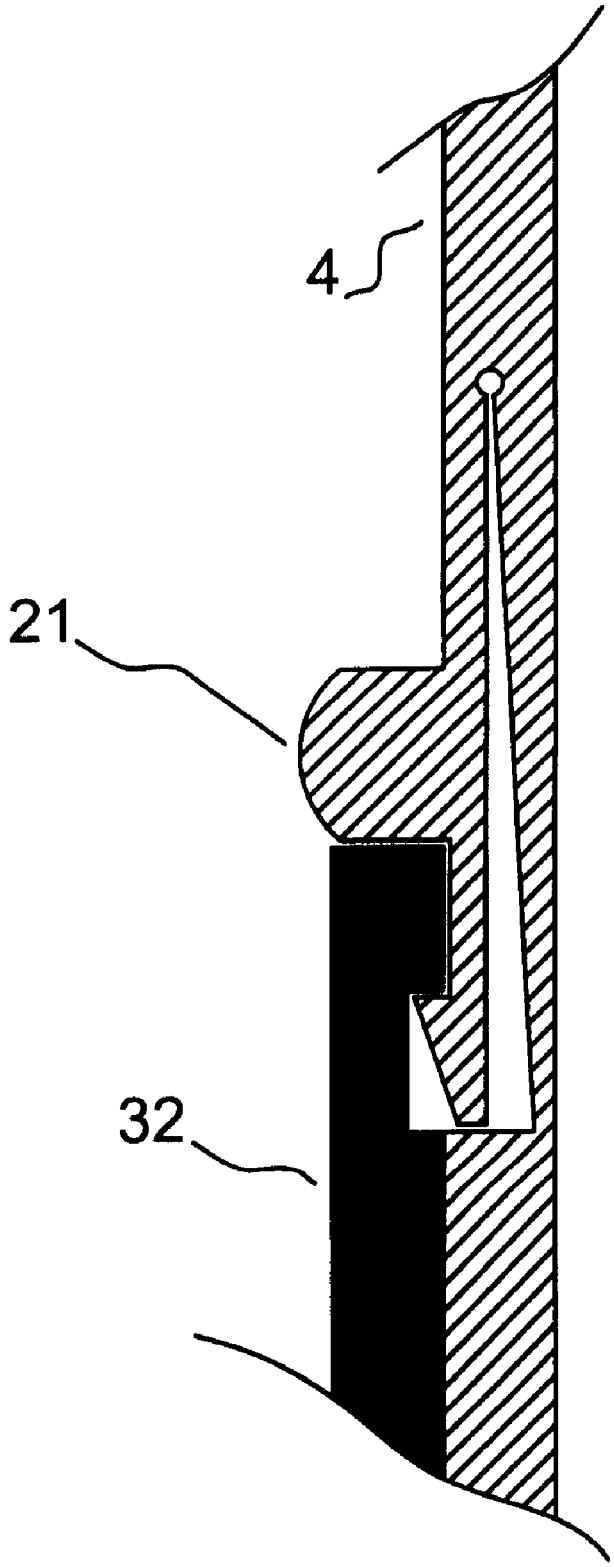
FIG. 14 is a locally enlarged view of the fastening clip on the single sliding sleeve as shown in FIG. 13.

In embodiments, the transformable device may include only a single sliding sleeve 32 as the locking device, as shown in FIG. 13, which may be desirable for small wind instrument such as a flute. In such embodiments, the single sliding sleeve 32 may be secured or locked via a fastening clip 21, located for example on upper panel 4. The fastening clip 21 may be secured to the single sliding sleeve 32 by clipping into a corresponding recessed space formed into the single sliding sleeve 32, as shown in FIG. 14. The fastening clip 21 may be released from the single sliding sleeve 32 by pressing on the fastening clip 21 to move the fastening clip out of the recessed space.

Figure 12:
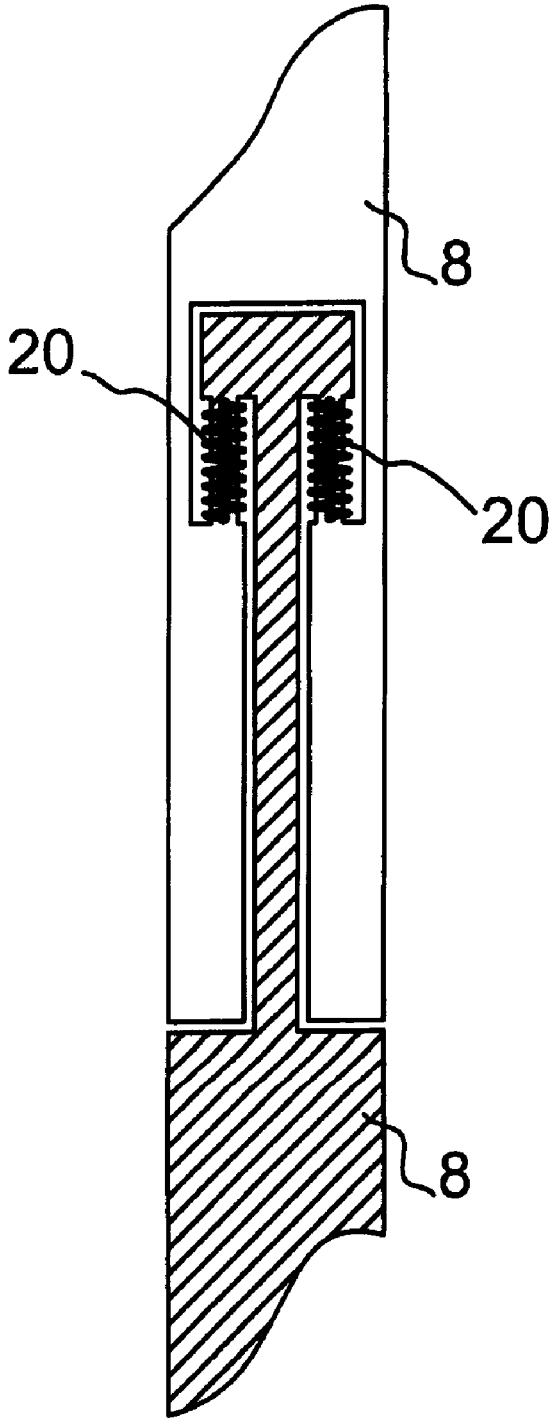
FIG. 12 is a partial section view of a spring-action device housed inside lower side panels of a transformable device.

In embodiments, a spring device 20 may be fitted to one or more of the upper panels 4 and lower panels 8, which allows the corresponding panels to compress/expand without deforming, as shown in FIG. 12. This allows a smooth movement of the corresponding panels during operation of the transformable instrument stand/case.

In embodiments, the components of the transformable device may be made from one or more materials including, but not limited to, wood (e.g., hardwood, softwood and wood laminates), metals (e.g., aluminum, brass, copper, zinc or metal alloys), plastic (e.g., acrylic, polyvinylchloride, nylon), carbon fiber, rubber, fiberglass, cardboard and the like. The transformable device may be completely or partially transparent or semi-transparent. The transformable device may comprise decorative embellishments such as, for example, engravings, art work, lacquer and the like. The transformable device may be smooth or rough to the touch.

In embodiments, the transformable device may comprise an inner lining, for example cloth or fiber, for reducing or preventing condensation formation or build-up. The inner lining may be located on an interior of the transformable device, for example, on an interior surface of the walls/panels of the transformable device. The inner lining may be made from the same or different materials as the transformable device. The inner lining may be made from a soft material, such as cloth or foam, to reduce or prevent scratching or damaging the instrument.

In embodiments, the transformable device may be configured to provide one or more of impact, abrasion, vibration, moisture or general mechanical protection for the instrument. For example, the instrument case may be fitted with or coated with a rubber portion on an exterior or interior of the transformable device to provide the impact, abrasion, vibration, moisture or general mechanical protection for the instrument.

Desirably, areas prone to impact and abrasion may be fitted or coated, such as corners and a bottom surface of the transformable device. However, any and all portions of the transformable device may be fitted and or coated.

Various adaptations and modifications of the above described embodiments can be configured without departing from the scope and spirit of the invention. Therefore, it is to be understood that the present disclosure may be practiced other than as specifically described herein. The present disclosure is thus intended to be illustrative, and not restrictive.

What is claimed is:

1. An instrument case that is transformable into a stand for holding an instrument, comprising:

a base comprising a plurality of lower panels; and a movable portion comprising a plurality of upper panels that are each pivotably attached on a lower side thereof to a corresponding one of the lower panels and each attached on an upper side thereof to an upper case portion, wherein the instrument case is configured to transform into the stand upon movement of the upper case portion toward the base, thereby causing the upper panels and the lower panels to extend outwardly from a center of the instrument case.

2. The instrument case according to claim 1, wherein the upper panels and the lower panels cooperate to form legs of the stand.

3. The instrument case according to claim 1, wherein the number of upper panels is three and the number of lower panels is three, and the instrument case has a triangular cross section in its case configuration.

4. The instrument case according to claim 1, wherein:

each upper panel comprises a spring device that allows the upper panel to compress/expand without deforming.

5. The instrument case according to claim 1, further comprising:

a lid rotatably or removably connected to the upper case portion.

6. The instrument case according to claim 1, further comprising:

a locking device that is disposed around an outer circumference of the instrument case.

7. The instrument case according to claim 6, wherein the locking device comprises:

an upper sliding portion and a lower sliding portion;

a lock that is mounted to one of the upper sliding portion and the lower sliding portion and that is configured to lock the upper sliding portion and the lower sliding portion together.

8. The instrument case according to claim 7, further comprising:

a lower protrusion formed on the lower case portion that prevents the lower sliding portion from sliding below the protrusion when the locking device is unlocked.

9. The instrument case according to claim 7, further comprising:

an upper protrusion formed on the upper case portion that prevents the upper sliding portion from sliding above the protrusion when the locking device is unlocked.

10. The instrument case according to claim 7, further comprising:

a swivel device that presses against one of the upper panels or lower panels;

wherein the swivel device is configured to press against the one of the upper panels or lower panels when a corresponding one of the upper sliding portion and the lower sliding portion is slid past the pivotably connected portion connecting the lower panel to the upper panel.

11. The instrument case according to claim 1, further comprising:

a holding device that is fixedly mounted to the base on an interior of the instrument case, the holding device being configured to hold an instrument.

12. The instrument case according to claim 11, further comprising a lid, the lid comprising a holding member configured to hold the instrument on an end opposite to an end held by the holding device.

13. The instrument case according to claim 1, further comprising:

an elastic ring disposed in the base that provides cushioning for an instrument to be stored in the case.

14. An instrument case that is transformable into a stand for holding an instrument, comprising:

a lower case portion;

a lower movable portion comprised of a plurality of lower panels, each of the panels being pivotably attached to the lower case portion;

an upper movable portion comprised of a plurality of upper panels, wherein each of the upper panels is pivotably attached on a lower side thereof to a corresponding one of the lower panels, and wherein each of the upper panels is attached on an upper side thereof to an upper case portion;

a slidable locking device that is disposed around an outer circumference of the instrument case, and a lid rotatably or removably connected to the upper case portion.

15. The instrument case according to claim 14, further comprising:

a lower protrusion formed on the lower case portion that prevents the slidable locking device from sliding below the protrusion, when the slidable locking device is unlocked.

16. The instrument case according to claim 14, wherein the instrument case is configured to transform into the stand by moving the upper case portion toward the lower case portion, thereby causing the upper panels and the lower panels to rotate outwardly from a center of the instrument case, and wherein the upper panels and the lower panels cooperate to form legs of the stand.

17. The instrument case according to claim 14, further comprising:

a swivel device that presses against one of the upper panels or lower panels;

wherein the swivel device is configured to press against the one of the upper panels and lower panels when the slidable locking device is slid past the pivotably connected portion connecting the lower panel to the upper panel.

18. A method of transporting an instrument and supporting the instrument in an instrument case, wherein the instrument case comprises:

a lower case portion;

a lower movable portion comprised of a plurality of lower panels, each of the panels being pivotably attached to the lower case portion;

an upper movable portion comprised of a plurality of upper panels, wherein each of the upper panels is pivotably attached on a lower side thereof to a corresponding one of the lower panels, and wherein each of the upper panels is attached on an upper side thereof to an upper case portion;

a slidable locking device that is disposed around an outer circumference of the instrument case, and a lid rotatably or removably connected to the upper case portion;

the method comprising:

containing the instrument within the instrument case;

exposing the instrument to an outside by moving a movable portion of the instrument case along a longitudinal axis of the instrument case such that at least a portion of the musical instrument is not contained within the instrument case, and supporting the exposed instrument within the instrument case.

19. The method of claim 18, wherein the instrument is a flute.

* * * * *